US006114617A

United States Patent [19]

Scheib

[11] Patent Number: 6,114,617

[45] Date of Patent: Sep. 5, 2000

[54] GUITAR WITH SHORT SEVENTH STRING AND SHIFT LEVER FOR EASY CONVERSION TO BANJO TUNING

[76] Inventor: Donald Albert Scheib, 16360 Gordon Way, San Leandro, Calif. 94578

[21] Appl. No.: 09/079,106

[22] Filed: May 14, 1998

[51] Int. Cl.[7] ..... G10D 3/14

[52] U.S. Cl. ..... 84/312 R; 84/267

[58] Field of Search ..... 84/269, 267, 268, 84/290, 312 R

[56] References Cited

U.S. PATENT DOCUMENTS

| | | | |
|---|---|---|---|
| 480,816 | 8/1892 | Haney | 84/269 |
| 524,114 | 8/1894 | Parker | 84/268 |
| 542,165 | 7/1895 | Libby | 84/269 |
| 568,108 | 9/1896 | Brown | 84/267 |
| 607,359 | 7/1898 | Forrest | 84/267 |
| 1,431,250 | 10/1922 | Oettinger | 84/274 |
| 1,634,730 | 7/1927 | Travaglini | 84/269 |
| 1,652,627 | 12/1927 | Jerome | 84/269 |
| 2,023,358 | 12/1935 | Porter | 84/269 |
| 3,392,618 | 7/1968 | Pelensky | 84/267 |
| 3,486,408 | 12/1969 | Gross | 84/267 |
| 3,633,452 | 1/1972 | Beasley | 84/263 |
| 3,834,267 | 9/1974 | Shubb | 84/318 |
| 4,213,368 | 7/1980 | Cox | 84/269 |
| 4,354,417 | 10/1982 | Glaser, II | 84/312 R |
| 4,408,515 | 10/1983 | Sciuto | 84/267 |
| 4,535,670 | 8/1985 | Borisoff | 84/312 R |
| 4,576,080 | 3/1986 | McLellan et al. | 84/267 |
| 4,643,069 | 2/1987 | Borisoff et al. | 84/306 |
| 4,738,178 | 4/1988 | Deering | 84/1.16 |
| 4,768,415 | 9/1988 | Gressett, Jr. et al. | 84/298 |
| 5,140,884 | 8/1992 | Bowden | 84/312 R |
| 5,442,987 | 8/1995 | Davis | 84/312 R |
| 5,485,773 | 1/1996 | Devitrysmith | 84/267 |
| 5,578,774 | 11/1996 | Dickson, II | 84/269 |
| 5,585,580 | 12/1996 | Higgins | 84/312 R |
| 5,682,003 | 10/1997 | Jarowsky | 84/267 |
| 5,837,912 | 11/1998 | Eagen | 84/267 |

FOREIGN PATENT DOCUMENTS

| | | |
|---|---|---|
| 397564 | 8/1933 | United Kingdom . |
| 7939 | 5/1989 | United Kingdom . |
| 14285 | 6/1992 | United Kingdom . |
| 26489 | 5/1997 | United Kingdom . |
| 1484 | 8/1999 | United Kingdom . |

*Primary Examiner*—Robert E. Nappi
*Assistant Examiner*—Kim Lockett
*Attorney, Agent, or Firm*—David Pressman

[57] ABSTRACT

A single instrument can be played as a guitar or a banjo with a simple adjustment. It has six guitar strings (1 to 6), plus a seventh, shorter string (7). Its neck (12) is widened for part (12W) of its length, starting from the body (10) and then narrows. The six strings run over the pickups (28 and 30) and tuning bridge (24) and are anchored on the backside. Their opposite ends are wound around the tuning pegs at the end of the neck. A shift lever (38S) is attached to the first peg for rapidly changing the tuning from its normal pitch, E, down to D. The seventh string is tuned to G, as with the fifth string of a banjo. Its ball or stopped end is captivated by a knurled adjustment nut (42) under the body. It passes through the body and over the bridge (24), the pickups (28 and 30), over the body and widened part of the neck. Its free end is anchored at an anchor hole (12H) in the neck. To play the instrument as a guitar, the player uses the first six strings, which are tuned to the guitar pitches, i.e., E, B, G, D, A, and E. To play it as a banjo, the player down-tunes the first string to D using the shift lever. The resultant first four strings will be tuned to the first four banjo strings, D, B, G, D, and G, and the half string is already tuned to G, as with the fifth string of a banjo.

19 Claims, 3 Drawing Sheets

GUITAR WITH SHORT SEVENTH STRING AND SHIFT LEVER FOR EASY CONVERSION TO BANJO TUNING

BACKGROUND

1. Field of Invention

This invention relates generally to musical instruments, specifically to stringed instruments, and more specifically to stringed instruments that can be converted easily from one type, of stringing such as a guitar, to another type, of stringing such as a banjo.

2. Prior Art

Guitars come in two types: acoustic, where no electrical pickups are provided on the guitar, and electrical, where electronic pickups are provided on the guitar for sending a signal representing the guitar's sound to an amplifier. Acoustic guitars produce a round sound and are used mainly for classical, flamenco, and folk music, while electrical guitars have a thinner sound and are used for mainly for jazz, country and western, and rock music, although the two types of guitars are often used interchangeably for the same type of music. Acoustic guitars come in two types: those with nylon strings (mellower sound) and those with steel strings (more metallic sound, scratch guard on body's face under strings, and thinner neck). They usually have a hollow wooden body with a thin front face or soundboard with a sound hole and a thin rear face, while electric guitars usually have a solid body. The bodies of both types usually have a figure-eight shaped outline, with electric guitars having one or two large notches or indentations in the smaller end for enabling the player to reach frets on the body. Both types have a neck extending from the smaller end of the body, with strings extending from the body to the distal end of the neck.

Banjos, on the other hand, usually have a circular body with a circular wooden or rigid frame and a skin or drumhead extending over the frame in lieu of a soundboard. A long neck with attached strings extends from the body. Banjos produce a twang-like, hollow, reedy sound and are used mainly for bluegrass and rural music, although, as with the two types of guitars, there is often considerable overlap between banjos and guitars for the same type of music.

A guitar usually has six strings. Assuming the guitar is held for play, with the neck on the player's left, these strings are numbered from 1 to 6, starting from the physically lowermost string. They are tuned as follows: 1-E; 2-B; 3-G; 4-D; 5-A; 6-E, with string 1 being thinnest and having the highest pitch (high E) and the strings progressing down in pitch to string 6, which has the lowest pitch (low E) and is thickest.

A banjo usually has five strings with the following tuning from highest pitch to lowest: 1-D; 2-B; 3-G; 4-D; 5-G.

Musicians often have to switch between banjos and guitars for different types of music. This requires that they carry and set up both types for a concert or performance. This is awkward, difficult, and expensive since it is necessary to buy, carry, and transport both instruments, keep both within easy reach in a safe spot during the performance, and set down one and pick up the other when switching.

U.S. Pat. No. 480,816 to Haney (1892) shows an instrument that Haney claims can be converted between a guitar and a banjo. To convert, two strings are removed and one is repositioned. This operation is awkward and impractical to perform.

Similarly, U.S. Pat. No. 1,634,730 to Travaglini (1927) shows an instrument with two necks and two respective bodies which are joined, one a guitar body and neck and one a banjo body and neck. This device is also awkward and would be expensive to produce.

U.S. Pat. No. 3,633,452 to Beasley (1972) also shows a combined guitar and banjo. A banjo head is provided in the guitar body and a mechanism is provided to selectively engage the strings with the banjo bridge. This arrangement is also awkward and expensive.

Various other stringed guitar and banjo-line instruments of interest have been patented. These do not solve the two-instrument problem above, but are mentioned as they are somewhat physically related to the present invention.

U.S. Pat. No. 607,359 to Forrest (1898) shows a five-string instrument with a device (FIG. 3) to produce tremolo. The fifth string is shorter and the portion of the neck beyond the tightening screw (b') for the fifth string is narrowed.

U.S. Pat. No. 3,392,618 to Pelensky (1968) shows a twelve-string guitar with a neck with two narrowing steps, similar to Forrest's.

U.S. Pat. No. 3,486,408 to Gross (1969) shows a guitar that can be converted to one with fewer strings by using a member to move selected strings away from the plane of play.

U.S. Pat. No. 3,834,267 to Shubb (1974) shows a slideable capo for the fifth string of a banjo.

U.S. Pat. No. 4,213,368 to Cox (1980) shows a banjo with a reinforced hole in the drumhead. Although not discussed, this banjo has a shorter fifth string and the portion of the neck beyond the tightening screw for the fifth string is narrowed, as with Forrest.

U.S. Pat. No. 4,738,178 to Deering (1988) shows an electric banjo with damped pickups. Although again not discussed, this banjo has a shorter fifth string and the portion of the neck beyond the tightening screw for the fifth string is again narrowed.

OBJECTS AND ADVANTAGES

Accordingly, several objects and advantages of the invention are to provide an improved string instrument, to provide one which musicians can use to play as a guitar or banjo without having to switch between the two instruments, to provide a way to play a guitar like both instruments without having to carry and set up both types for a concert or performance, to provide such an instrument that is less awkward, less difficult, and less expensive to buy, carry, and transport, which avoids the need to keep two instruments within easy reach in a safe spot during a performance, which enables a rapid and facile switch, and obviates the need to set down one and pick up the other when switching. Further objects and advantages will become apparent from a consideration of the ensuing description and the accompanying drawings.

DRAWING FIGURES

Figure 1A:
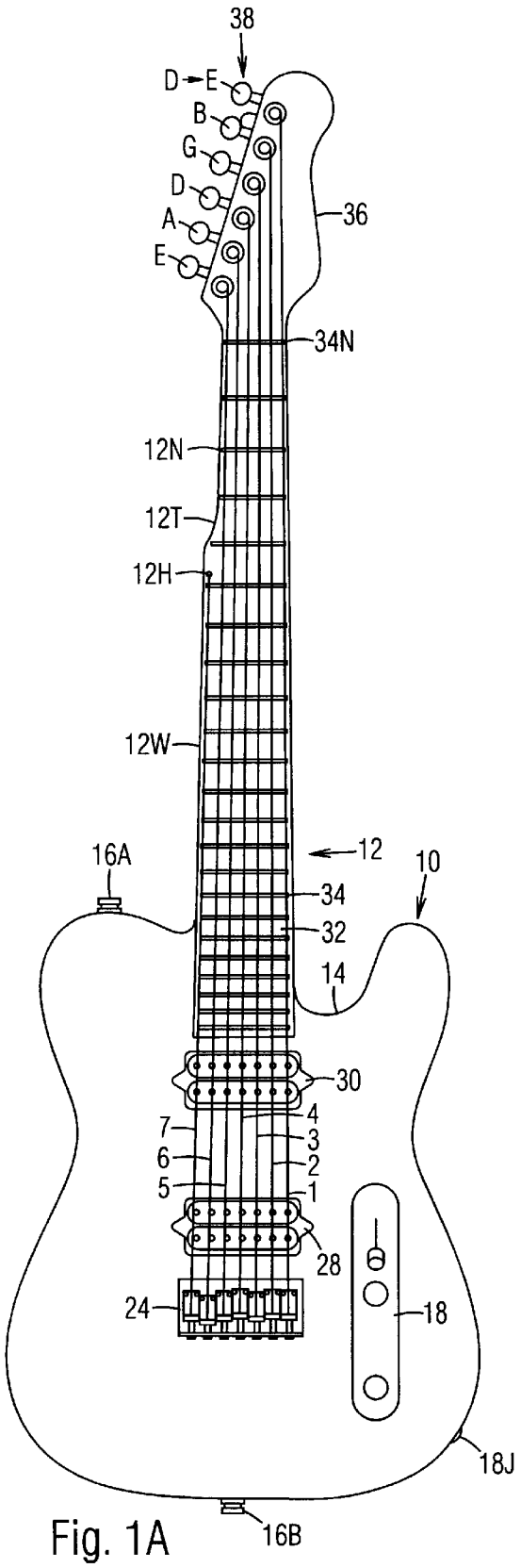
FIGS. 1A and 1B are front and rear views of a convertible guitar according to the invention.

| Drawing Reference Numerals | |
|---|---|
| 10 body | 12 neck |
| 12H hole | 12W wide portion |
| 12N neck portion | 12T transition |
| 14 access notch | 16 (A and B) strap anchors |
| 18 electronic control | 18J jack |
| 20 name plate | 26 anchor plate |
| 24 fine tuning bridge | 30 bass pickup |
| 28 treble pickup | 34 fret |
| 32 fingerboard | 36 head |
| 34N nut | 38S shift levers |
| 38 tuning pegs | 42 knob for seventh string |
| 40 stop block | |
| 44 anchor nut | |

SUMMARY

In accordance with the invention, a single instrument can be played as either a guitar or a banjo with a simple adjustment. The instrument has six guitar strings, plus a seventh, shorter, or half string. The neck is widened for a major portion of its length, starting from the body, to provide an area with frets for stopping any of the seven strings. Then the neck narrows to the usual width for the six strings that overly the remainder of the distance to the tuning pegs or knobs. The six strings run over the tuning bridge on the body and are anchored on the backside. Their opposite ends are wound around the tuning pegs or knobs at the distal end of the neck. A shift lever is attached to the peg for the first string for rapidly changing its tuning from its normal pitch, E, down to D. The seventh or half string is tuned to G, as with the fifth string of a banjo. It is attached as follows: Its ball or stopped end is captivated by a knurled adjustment nut under the body. It passes through the body and over the bridge, the pickups, over the body and widened part of the neck. Its free end is anchored at an anchor hole in the neck.

To play the instrument as a guitar, the player uses the first six strings in the normal manner. These are tuned to the normal guitar pitches, i.e., E, B, G, D, A, and E.

To play the instrument as a banjo, the player merely down-tunes the first string to D using the shift lever. The resultant first four strings will be tuned to the first four banjo strings, D, B, G, D, and G, and the half string is already tuned to G, as with the fifth string of a banjo. Thus the player can now play the instrument as a banjo by using the first four stings and the half string.

Figure 1B:
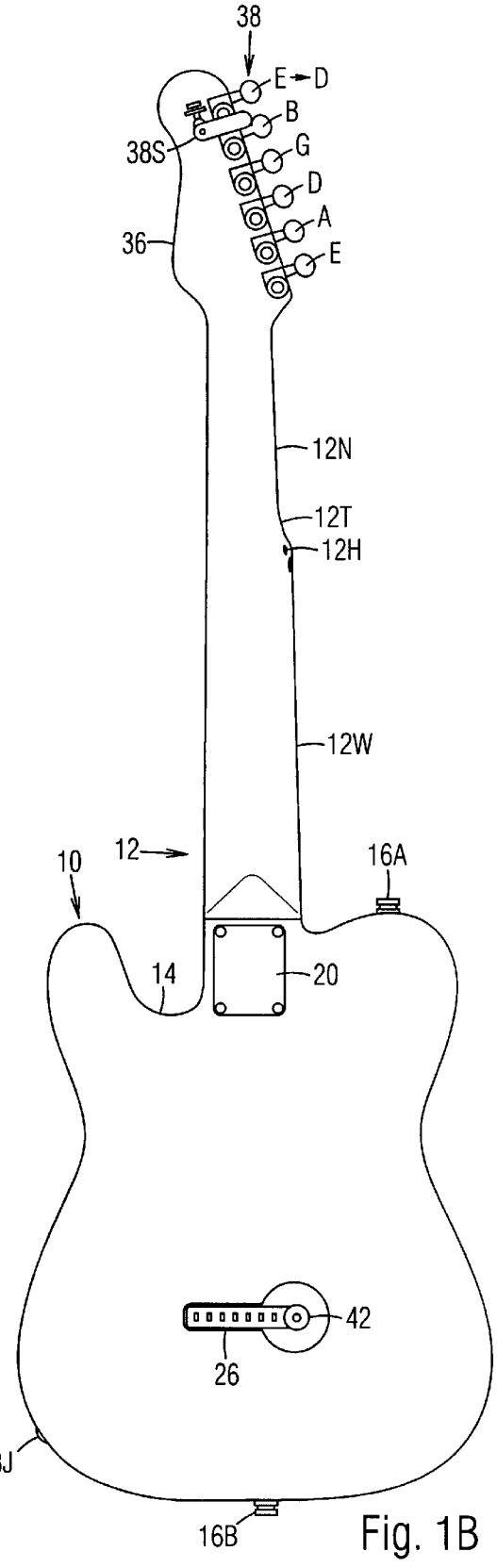

Description—FIGS. 1A and 1B—Overall Instrument

A convertible guitar is shown in FIG. 1A (front view) and FIG. 1B (rear view). The instrument comprises a body 10 and a neck 12.

Body 10 has the usual general figure-eight shape with an access notch 14 and carrying strap anchors 16A and 16B. A standard electronic control 18 is positioned on the front, an electronic output jack 18J on the bottom right, and a nameplate 20 is on the rear. The instrument has seven strings numbered 1 to 7 from right to left in FIG. 1A. The strings all extend over a fine tuning bridge 24 (described in more detail in connection with FIG. 4) and then pass through body 10 to the backside where they are anchored on a plate 26 (FIG. 1B and described in more detail in connection with FIG. 3). Returning to the front side, and moving up from bridge 24, the strings extend first over a dual-bank standard treble pickup 28 and then over a dual-bank standard bass pickup 30. Then they extend over a fingerboard 32 which contains the usual playing ridges or frets, such as 34, and which continues over neck 12. The top ridge 34N is called a nut and equalizes the vibratory length of the first six strings.

Neck 12 has a wide portion 12W adjacent body 10 and a narrower portion 12N at its distal end, adjacent head 36. Portions 12W and 12N are connected by a step or narrowing transition 12T. Portion 12W is wide enough to underlie all seven strings, while portion 12N is narrower since it underlies only the first six strings. The seventh string extends through a hole 12H just below transition 12T and is anchored in this hole. Head 36 has six standard and staggered tuning pegs 38, one for each of the first six strings. The tuning peg for the first (E) string has a standard shift lever 38S attached, as more fully discussed in connection with FIGS. 5A and 5B.

Figure 3:
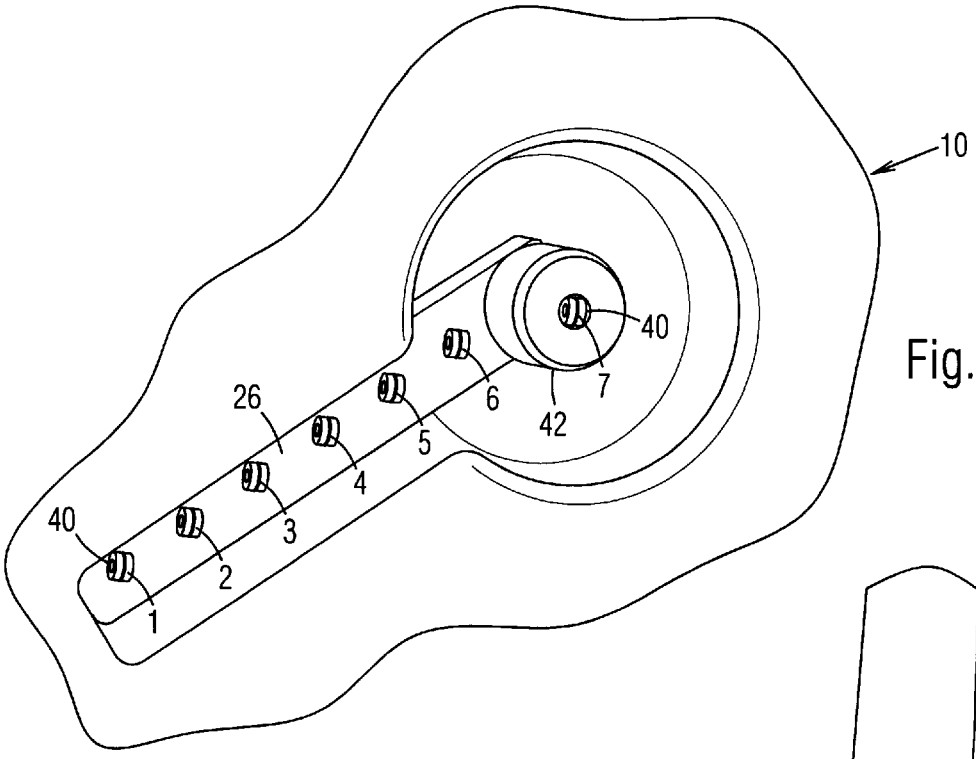
FIG. 3 is a partial view of the back of the instrument showing the anchorage of six strings and the adjustment knob for the seventh string.
Figure 4:
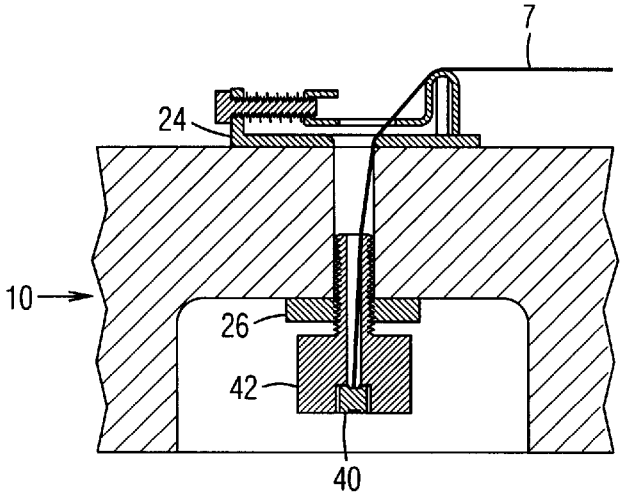
FIG. 4 is a sectional view of the adjustment knob of the seventh string.
Figure 2:
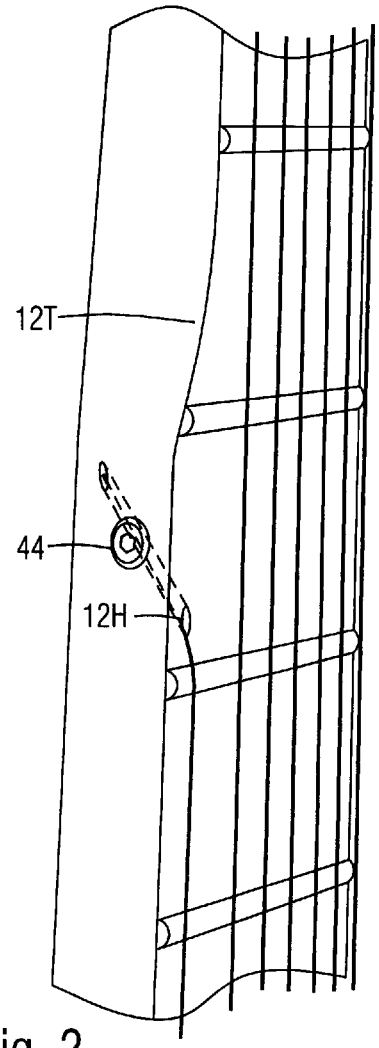
FIG. 2 is a partial view of the neck of the instrument showing the anchorage of a seventh string.

Description—FIGS. 2 to 4—Half-String Anchor and Adjustment

Details of the anchorage and adjustment for the half or seventh string are shown in FIGS. 2 to 4.

FIG. 3 is a view of anchor plate 26 in a recess on the backside of the instrument. Plate 26 has six holes in a row that anchor and hold the first six strings and a knob 42 that holds the seventh string. Each string has a stop block or ball, such as 40, on its end.

Each of the first six strings is threaded through a respective hole in plate 26, up through body 10, over bridge 24 on the front side (FIG. 1A), treble pickup 28, bass pickup 30, over neck 12 and its fingerboard and frets, to a respective one of tuning pegs 38. Fine tuning bridge 24 is conventional and contains seven adjusting screws as indicated to provide a fine adjustment to the tensions and hence tuning of the seven strings in conventional fashion.

The seventh or half string (FIG. 4) has an end stop 40 that is captivated in adjusting knob 42. This string extends through knob 42 in the recess on the backside of body 10, through a hole in body 10, over fine tuning bridge 24, over treble pickup 28, over bass pickup 30, over neck 12 and its fingerboard and frets, and through hole 12H near transition 12T in the neck. An anchor nut 44 on the top side of the neck tightens against the seventh string in hole 12H to hold it in place. Gross tension adjustment for the seventh string is provided by knob 42: turning this knob moves it into or farther out of body 10, thereby adjusting the tension and hence tuning of the seventh string. When knob 42 is so turned, the stop block on the seventh string remains fixed and hence slips with respect to the knob so that the string does not become twisted during tuning.

Figure 5A:
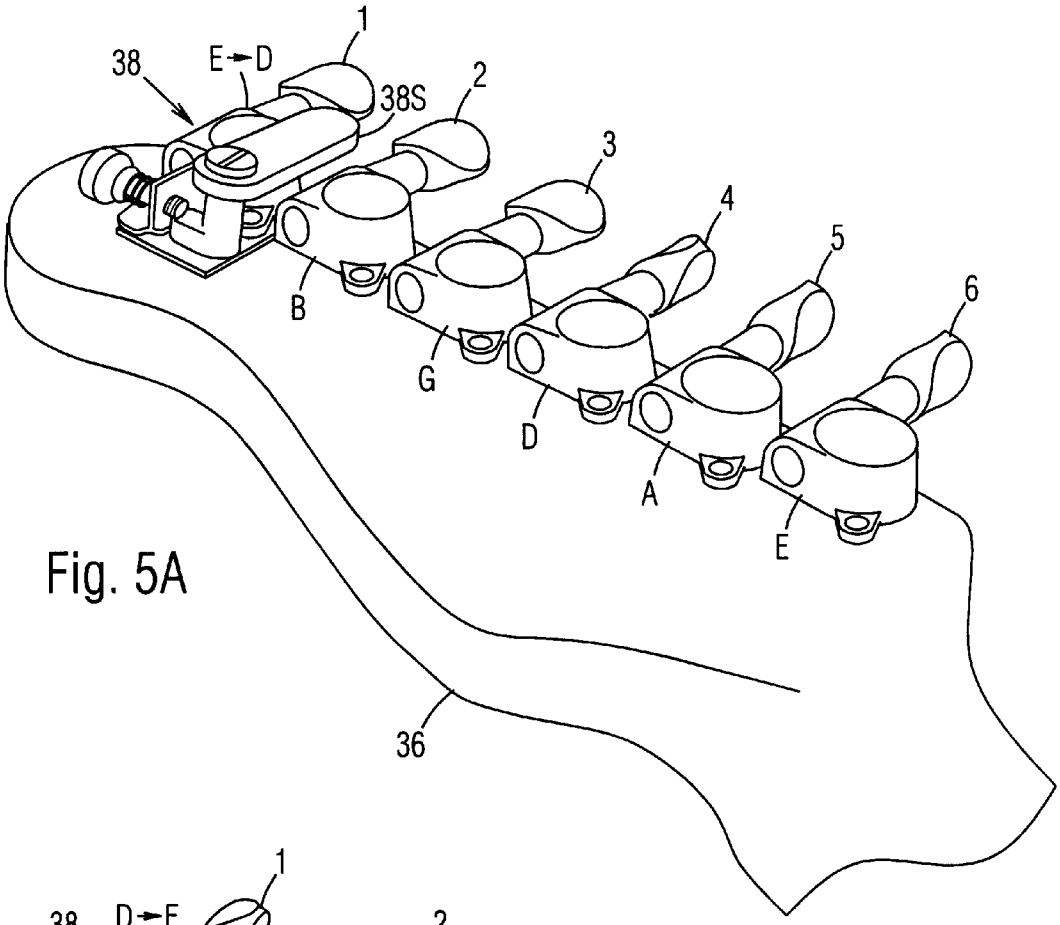
FIGS. 5A and 5B are perspective views of the backside of the head of the instrument, showing string adjustment pegs and shift levers.
Figure 5B:
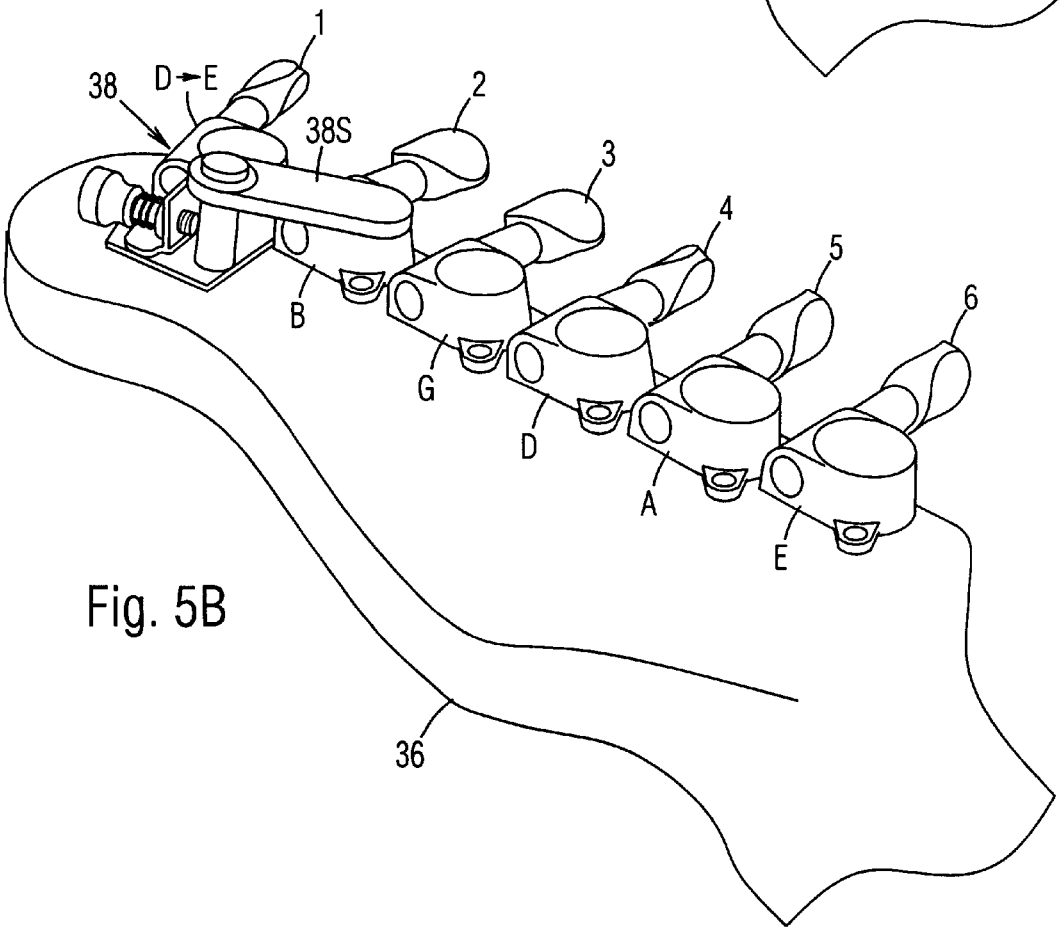

Description—FIGS. 5A and 5B—Tuning Pegs and Shift Lever

FIGS. 5A and 5B show details of the tuning pegs and the first string's shift lever at the head of the instrument. As shown in FIG. 5A, there are six pegs 38, one for each of strings 1 to 6. The details and operation of these pegs, which drive a pinion which in turn drives a rack gear, are well known and will not be shown or reviewed. Suffice it to say that turning any peg can loosen or tighten, and hence change the pitch of, its associated string. Fine adjustments of these six strings can be made by adjusting the screws on fine tuning bridge 24 (FIG. 4). As indicated, these six strings are normally tuned to E, B, G, D, A, a nd E, as in a conventional guitar.

The peg for string 1 also has a shift lever 38S connected thereto for changing the pitch of this string one full note down. This shift lever is conventional per se and will not be detailed here. When the shift lever is actuated by rotating it about ¼ turn clockwise when seen from above, it will cam the entire pinion and rack of the first peg counterclockwise and thereby relax or slacken the first string so as to change its tuning from E to D (one full note). Shift lever 38S extends up and has a short operating lever so that when actuated (rotated clockwise), it will not hit the adjacent peg (#2).

In FIG. 5B, the shift lever has been rotated about ¼ turn clockwise, so that it cams the first peg slightly counterclockwise, thereby changing the tuning of the first string from E to D, as indicated.

Operation

To play the instrument as a guitar, lever 38S is left in its normal position (FIG. 5A) so that the first six strings are tuned to the normal guitar pitches, E, B, G, D, A, and E. The instrument is played in the normal fashion as a guitar by strumming only the first six strings. The seventh or half string is not used.

To play the instrument as a banjo, shift lever 38S is rotated clockwise to the position shown in FIG. 5B, thereby rapidly and simply and accurately changing the tuning of the first string from E to D. The first four strings and the seventh string are now tuned to the normal banjo pitches, D, B, G, D, and G. The instrument is played in the normal fashion using the first four and the seventh strings. The fifth and six strings are not used.

To play the instrument again as a guitar, lever 38S is rotated back in a counterclockwise manner as shown in FIG. 5A and the first six strings are played again.

To tune the first six strings, the user turns tuning pegs 38 in the normal manner. To tune the seventh string, the user turns knob 42 on the backside of the instrument is turned in or out. To fine-tune any string, the user adjusts the appropriate nut in fine tuning bridge 24.

Conclusion, Ramifications, and Scope

Accordingly the reader will see that, according to the invention, I have provided an improved string instrument, which musicians can use to play as a guitar or banjo without having to switch between the two instruments. The musician can play both instruments without having to carry and set up both for a concert or performance. The single instrument is less awkward, less difficult, and less expensive to buy, carry, and transport. It obviates the need to keep two instruments within easy reach in a safe spot during a performance, and also obviates the need to set down one and pick up the other when switching. The musician can make the switch rapidly and facilely.

While the above description contains many specificities, these should not be construed as limitations on the scope of the invention, but as exemplifications of the presently preferred embodiments thereof. Many other ramifications and variations are possible within the teachings of the invention.

For example, additional shift levers can be provided on adjacent pegs for changing the pitch of other strings for playing different compositions.

Instead of using a shift lever as the pitch changer, the peg itself can be turned to change the pitch of the first string, albeit at some loss in speed and convenience.

While an electric guitar is shown, the changeover system is also applicable to acoustic guitars of either the nylon-string or steel-string type.

The principle of the invention can also be used to change the tuning of virtually any other type of string instrument to that of another string instrument with different tuning, especially where:

(a) an instrument of a first type has N+1 strings (e.g., six, like the guitar) and an instrument of a second type has N strings (e.g., five like the banjo), (b) one string of the first type of instrument has a given tuning and a corresponding string of the second type of instrument has a slightly different tuning, and (c) the strings of the first type of instrument have a given set of tunings, and one of the strings of the second type of instrument has a substantially different tuning than any string of the first type of instrument.

An instrument using the present inventive principle would have N+2 strings. A player can play it as an instrument of the first type by playing N+1 of its N+2 strings: its one string is played but its N+2d string is not played. The player can easily convert it to an instrument with tuning of the second type by (a) changing the tuning of the one string to that of the one string of the second type of instrument using a shift lever, and (b) playing N−2 of its strings, including the one string and its N+2d string; the player would not play two of its strings.

Instead of changing the pitch of the string by one full note, the shift lever can be arranged to change it by a half note or an integral number of half notes.

Instead of a stepped neck, it can have a single width.

Thus the scope of the invention should be determined by the appended claims and their legal equivalents, and not by the examples given.

I claim:

1. A string instrument whose tuning can be interchanged rapidly between the tunings of instruments of first and second types, where said instrument of said first type has N+1 strings, N being is an integer, and said instrument of said second type has N strings, and where one string of said instrument of said second type is relatively close in tuning to one string of said instrument of said first type, and another string of said instrument of said second type is less close in tuning to any string of said instrument of said first type, said string instrument comprising:

a supporting body, said supporting body having N+2 strings stretched across one side of said body, said N+2 strings being spaced from said body for most of their length, a first of said strings being tuned to said tuning of said one string of said first type of instrument, pitch-changing means for rapidly, accurately, and with a single motion changing the tuning of said first of said strings to said tuning of said one string of said second type of instrument, another of said strings being tuned to the tuning of said other string of said second type of instrument, whereby said instrument can be played with the tuning of said first type of instrument by playing all of said N+2 strings, except said other string, and whereby said instrument can be converted to and played with the tuning of said second type of instrument by activating said pitch-changing means to change the tuning of said first of said strings to the tuning of said one string of said second type of instrument, playing said first string, said other of said strings, and N−2 of the rest of said strings.

2. The string instrument of claim 1 wherein N is five, so that said first type of instrument has six strings, and said second type of instrument has five-strings.

3. The string instrument of claim 1 wherein said pitch-changing means comprises a shift lever that is arranged, upon actuation thereof, to change the pitch of said first string by a full note.

4. The string instrument of claim 1 wherein said instrument has an elongated neck attached to and extending from said body and said strings are all attached at one end onto said body and, at their other ends, N+1 strings are attached to an end of said neck distal from said body and the remaining, N+2d, string is attached to a point on said neck between said end thereof distal from said body and said body.

5. The string instrument of claim 4 wherein said remaining, N+2d string extends through a hole in said neck and is anchored at said hole and the other end of said remaining, N+2d string extends through said body and is anchored on a side of said body opposite said one side thereof, and further including means on said opposite side of said body for adjusting the tension of said remaining, N+2d string.

6. The string instrument of claim 1 wherein N is five, so that said first type of instrument has six strings, said second type of instrument has five strings, and said pitch-changing means comprises a shift lever which is arranged, upon actuation thereof, to change the pitch of said first string by a full note.

7. A string instrument whose tuning can be interchanged rapidly between the tunings of instruments of first and second types, where said instrument of said first type has N+1 strings, N being is an integer, and said instrument of said second type has N strings, and where one string of said instrument of said second type is relatively close in tuning to one string of said instrument of said first type, and another string of said instrument of said second type is less close in tuning to any string of said instrument of said first type, said string instrument comprising:

a supporting body and a neck attached to and extending from said body, said supporting body having N+2 strings stretched across one side of said body and said neck, said N+2 strings being spaced from said body for most of their length, a first of said strings being tuned to the tuning of said one string of said first type of instrument, a shift lever for rapidly, simply, and accurately changing the tuning of said first string to the tuning of said one string of said second type of instrument upon actuation of said shift lever, another of said strings being tuned to the tuning of said other string of said second type of instrument, whereby said instrument can be played with the tuning of said first type of instrument by playing all of said N+2 strings, except said other string, and whereby said instrument can be converted to and played with the tuning of said second type of instrument by activating said pitch-changing means to change the tuning of said first of said strings to the tuning of said one string of said second type of instrument, playing said first string, said other of said strings, and N−2 of the rest of said strings.

8. The string instrument of claim 7 wherein N is five, so that said first type of instrument has six strings, and said second type of instrument has five strings.

9. The string instrument of claim 7 wherein said shift lever is arranged, upon actuation thereof, to change the pitch of said first string by a full note.

10. The string instrument of claim 7 wherein said strings are all attached at one end thereof onto said body and at their other ends N+1 strings are attached to an end of said neck distal from said body and the remaining, N+2d string, is attached to a point on said neck between said end of said neck distal from said body and said body.

11. The string instrument of claim 10 wherein said remaining, N+2d string extends through a hole in said neck and is anchored at said hole and the other end of said remaining, N+2d string extends through said body and is anchored on a side of said body opposite said on side thereof, and further including an adjustment screw on said opposite side of said body for adjusting the tension of said remaining, N+2d string.

12. A method of rapidly interchanging the tuning of a string instrument between the tunings of instruments of first and second types, where said instrument of said first type has N+1 strings, N being is an integer, and said instrument of said second type has N strings, and where one string of said instrument of said second type is relatively close in tuning to one string of said instrument of said first type, and another string of said instrument of said second type is less close in tuning to any string of said instrument of said first type, said method comprising:

providing a supporting body with N+2 strings stretched across one side of said body and spaced from said body for most of their length, a first of said strings being tuned to the tuning of said one string of said first type of instrument, another of said strings being tuned to the tuning of said other string of said second type of instrument, providing on said body pitch-changing means for rapidly, accurately, and with a single motion changing the tuning of said first of said strings to said tuning of said one string of said second type of instrument, playing said instrument as said first type of instrument by playing all of said N+2 strings except said other string, and converting said instrument to enable it to be played as said second type of instrument by operating said pitch changer to change the tuning of said first string to the tuning of said one string of said second type of instrument, and playing said first string, said other of said strings, and N−2 of the rest of said strings, so as to play said instrument as said second type of instrument.

13. The method of claim 12 wherein said providing a supporting body comprises providing a body where N is five, so that said first type of instrument has six-strings, and said second type of instrument has five strings.

14. The method of claim 12 wherein said providing on said body pitch-changing means comprises providing, as said pitch-changing means, a shift lever that is arranged, upon actuation thereof, to change the pitch of said first string by a full note.

15. The method of claim 12 wherein said providing a supporting body comprises providing a supporting body with an elongated neck attached to and extending from said body where said strings are all attached at one end to said body and at their other ends N+1 strings are attached to an end of said neck distal from said body and the remaining, N+2d string, is attached to a point on said neck between said end of said neck distal from said body and said body.

16. The method of claim 15 wherein said providing a supporting body also comprises making said remaining, N+2d string to extend through a hole in said neck and anchoring said string at said hole and extending the other end of said remaining, N+2d string through said body and anchoring it on a side of said body opposite said on side thereof, and further including providing means on said opposite side of said body for adjusting the tension of said remaining, N+2d string.

17. The method of claim 12 wherein said providing a supporting body comprises providing a body where N is five, so that said first type of instrument is a six-string guitar, and wherein said providing on said body pitch-changing means comprises providing, as said pitch changing means, a shift lever which is arranged, upon actuation thereof, to change the pitch of said first string by a full note.

18. The method of claim 12, further including:

playing said instrument as said first type of instrument again by re-operating said pitch changer to change the tuning of said first string back to the tuning of said one string of said first type of instrument, and playing said instrument as said first type of instrument by playing all of said N+2 strings except said other string.

19. The method of claim 12 wherein:

(a) said providing a supporting body comprises providing a body in which:

(1) N is five, so that said first type of instrument has six-strings, and said second type of instrument has five-strings, (2) said body has an elongated neck attached to and extending from said body, (3) said strings are all attached at one end thereof onto said body and at their other ends N+1 strings are attached to an end of said neck distal from said body and the remaining, N+2d string is attached to a point on said neck between said end thereof and said body, (4) said remaining, N+2d string extends through a hole in said neck and is anchored at said hole, and the other end of said remaining, N+2d string extends through said body and is anchored on a side of said body opposite said one side thereof, and (5) means are provided on said opposite side of said body for adjusting the tension of said remaining, N+2d string, and (b) said providing on said body pitch-changing means comprises providing as said pitch changing means a shift lever which is arranged, upon actuation thereof, to change the pitch of said first string by a full note.

* * * * *